US005126223A

United States Patent [19]

Kikuchi et al.

[11] Patent Number: 5,126,223

[45] Date of Patent: Jun. 30, 1992

[54] OZONE RESISTANT ELECTROPHOTOGRAPHIC PHOTOSENSITIVE MEMBER

[75] Inventors: Toshihiro Kikuchi, Yokohama; Tetsuro Kanemaru, Tokyo; Kouichi Suzuki, Kawasaki, all of Japan

[73] Assignee: Canon Kabushiki Kaisha, Tokyo, Japan

[21] Appl. No.: 650,988

[22] Filed: Feb. 4, 1991

Related U.S. Application Data

[63] Continuation of Ser. No. 318,248, Mar. 3, 1989, abandoned.

[30] Foreign Application Priority Data

Mar. 8, 1988 [JP] Japan ..... 63-54622

[51] Int. Cl.[5] ..... G03G 5/047

[52] U.S. Cl. ..... 430/59

[58] Field of Search ..... 400/58; 430/59

[56] References Cited

U.S. PATENT DOCUMENTS 4,539,282 9/1985 Morimoto et al. ..... 430/59 X 4,582,772 4/1986 Teuscher et al. ..... 430/59 X

FOREIGN PATENT DOCUMENTS 201447 9/1987 Japan ..... 430/59

40163 2/1988 Japan ..... 430/59

*Primary Examiner*—Roland Martin

*Attorney, Agent, or Firm*—Fitzpatrick, Cella, Harper & Scinto

[57] ABSTRACT

An electrophotographic photosensitive member having a photosensitive layer laminated on an electroconductive support, characterized in that the photosensitive layer contains a biphenyl compound represented by the following formula:

Formula: [I]

(wherein $R^1$ represents an alkyl group; $R^3$ represents an aralkyl group; $R^3$ and $R^4$ each represent an aromatic ring group; Ar and Ar′ each represent a divalent aromatic ring group).

10 Claims, 1 Drawing Sheet

OZONE RESISTANT ELECTROPHOTOGRAPHIC PHOTOSENSITIVE MEMBER

This application is a continuation of application Ser. No. 318,248 filed Mar. 3, 1989 abandoned.

BACKGROUND OF THE INVENTION

1. Field of the Invention

This invention relates to an electrophotographic photosensitive member, more particularly to an electrophotographic photosensitive member having a low molecular weight organic photoconductive material which gives improved electrophotographic characteristics.

2. Related Background Art

In recent years, a large number of electrophotographic photosensitive members by use of organic compounds as the photoconductive member have been developed. Among them, most have the form of the photoconductive member separated in function into the charge generating substance and the charge transporting substance.

However, these photosensitive members have been generally regarded to have a great drawback of low durability as compared with inorganic photosensitive members. Durability may be classified broadly into durability in aspect of electrophotographic properties such as sensitivity, residual potential, charging ability, fuzzy image, etc. and mechanical durability such as abrasion, damage, etc. on the photosensitive member surface caused by sliding. Concerning durability in aspect of electrophotographic properties, it has been caused mainly by deterioration of the charge transporting material containing in the surface layer of the photosensitive member with ozone generated by corona discharging, NOx or photoirradiation.

As the organic charge transporting material, there have been proposed a large number of compounds such as hydrazone compounds as disclosed in U.S. Pat. No. 4,150,987, triazolepyrazoline compounds as disclosed in U.S. Pat. No. 3,837,851, stilbene compounds as disclosed in Japanese Patent Laid-open Application No. 58-198043, benzidine compounds as disclosed in Japanese Patent Laid-open Application Nos. 59-295558 and 62-201447, and considerable improvements are being done, but not satisfactorily under the present situation.

Further, in recent years, a new problem of a resting memory phenomenon of photosensitive members has been pointed out as the durable life of photosensitive members is improved and the image quality is made higher. The resting memory phenomenon refers to one which is basically of the deterioration caused by the corona products, in which rotation of the photosensitive member after completion of copying stops, and the charging ability at the portion stopped near the corona charger is lowered, whereby the image density is lowered only at that portion in the case of normal developing or elevated in the case of reversal developing. This phenomenon is liable to occur after the photosensitive member has been used for a long term, and is now becoming a serious problem as the photosensitive member life is elongated in recent years.

SUMMARY OF THE INVENTION

An object of the present invention is to provide a novel photosensitive member which is free from problems of durability of electrophotographic physical properties such as sensitivity, residual potential, charging ability, fuzzy image, as a matter of course, and is also free from the resting memory phenomenon which has become a great problem in recent years.

More specifically, the present invention provides an electrophotographic photosensitive member having a structure with a photosensitive layer laminated on an electroconductive support, wherein the photosensitive layer contains a biphenyl compound represented by the following formula:

Formula: [I]

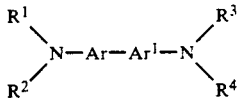

In the formula, $R^1$ represents an alkyl group such as methyl, ethyl, propyl, butyl, etc., which may also have substituent; $R^2$ represents an aralkyl group such as benzyl, phenethyl, naphthylmethyl, anthrylmethyl, etc., which may also have substituent. $R^3$ and $R^4$ each represent aromatic ring group such as phenyl, naphthyl, anthryl, etc. which may also have substituent; Ar and Ar' each represent divalent aromatic ring group such as benzene ring, naphthalene ring, anthryl ring, etc. which may also have substituent. $R^3$, $R^4$, Ar and Ar' may be either the same or different from each other.

Examples of the substituent which may be possessed by $R^1$, $R^2$, $R^3$, $R^4$, Ar and Ar' may include alkyl groups such as methyl, ethyl, propyl and the like; alkoxy groups such as methoxy, ethoxy, propoxy and the like; alkylthio groups such as methylthio, ethylthio, butylthio and the like; halogen atoms such as fluorine, chlorine, bromine and the like; nitro group; and so on.

DETAILED DESCRIPTION OF THE PREFERRED EMBODIMENT

Figure 1:
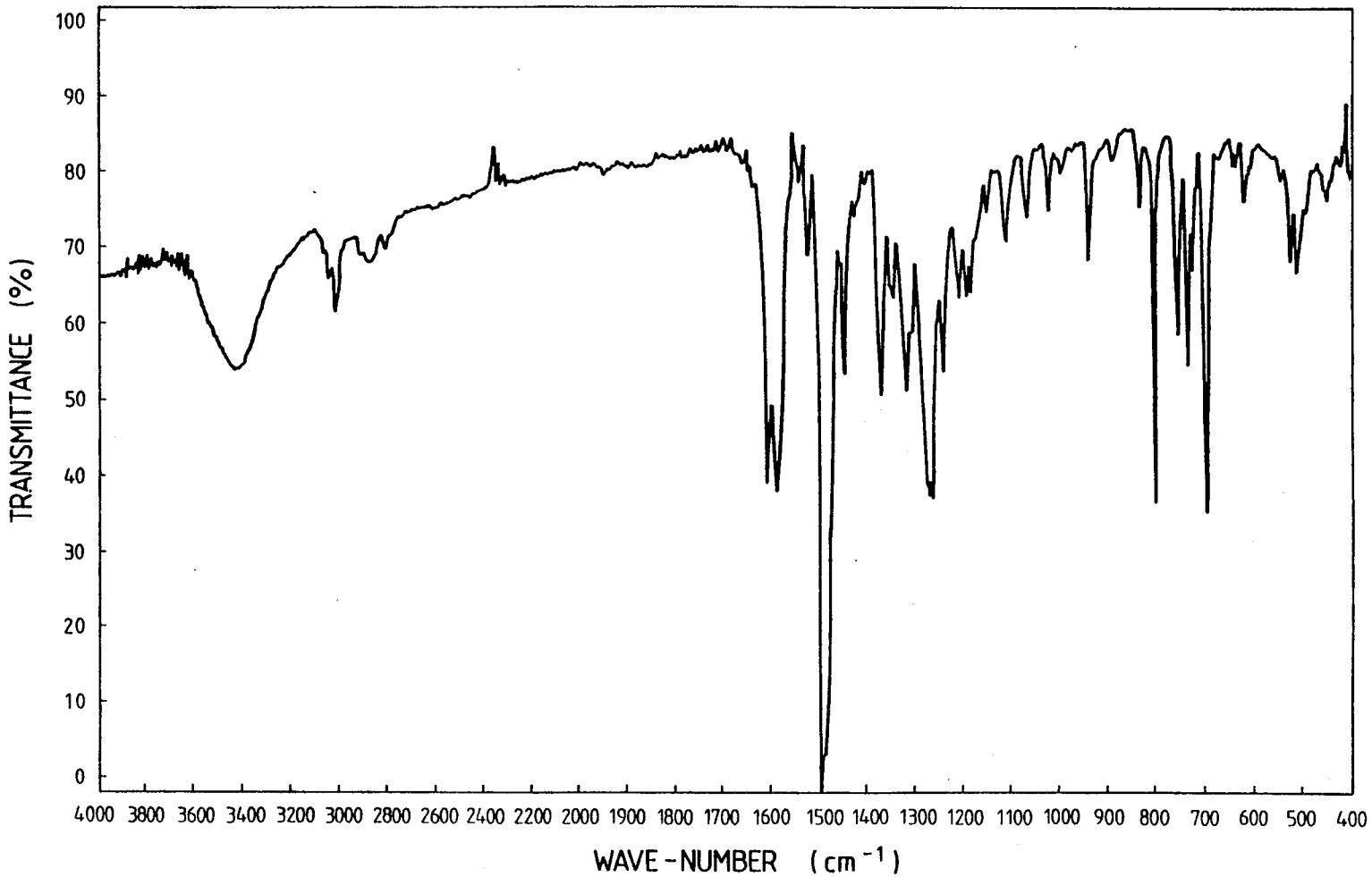
FIG. 1 is IR-ray absorption spectrum of an exemplary compound of the present invention.

The main cause for the resting memory phenomenon may due to the fact that $HNO_3$ generated through the reaction between Nox formed by corona charging and the water in the atmosphere affects badly the photosensitive layer to lower its charging ability. We were interested in the influence of $HNO_3$ on biphenyl compounds and consequently found that particularly by use of specific groups respectively for $R^1$ and $R^2$ of the biphenyl compound of the structure represented by the formula (I), the resting memory phenomenon by the influence of $HNO_3$ can be prevented by controlling the basicity of the biphenyl compound itself, and also lowering in sensitivity and potential fluctuation can be prevented.

To describe in more detail, when both of $R^1$ and $R^2$ in the formula (I) are aralkyl groups or aryl groups, the biphenyl compound itself has too weak basicity and therefore absorbs no $HNO_3$, whereby if the photosensitive consists of, for example, a charge generation layer and a charge transport layer, $HNO_3$ will pass through the charge transport layer to reach the charge generation layer interface, resulting in lowering in charging ability to cause the resting memory phenomenon to occur. On the other hand, when both of $R^1$ and $R^2$ are alkyl groups, the biphenyl compound itself is strong enough to form a salt with $HNO_3$, whereby the biphenyl compound itself is deteriorated to lower sensitivity or make the potential fluctuation during successive copying greater.

In contrast, when $R^1$ is an alkyl group and $R^2$ is an aralkyl group, the basicity can be adequately controlled to become intermediate between the above two cases, whereby although $HNO_3$ is more or less adsorbed but not to the extent to form a salt, while further $HNO_3$ is eliminated with lapse of time, and therefore $HNO_3$ will not reach the charge generation layer interface, and also the biphenyl compound will not be deteriorated with $HNO_3$. Accordingly, the resting memory phenomenon can be prevented, thereby preventing lowering in sensitivity or potential fluctuation during successive copying.

In the following, representative examples of the biphenyl compounds represented by the formula [I] are set forth.

(1)

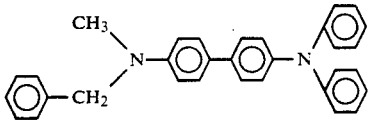

(2)

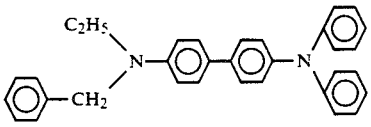

(3)

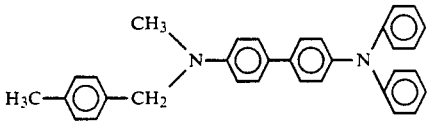

(4)

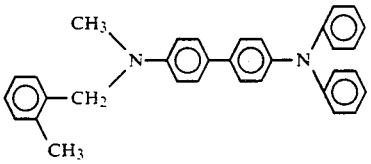

(5)

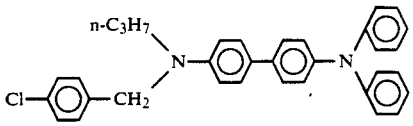

(6)

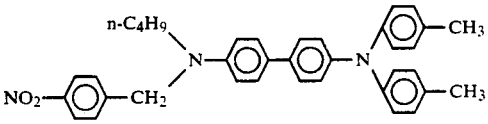

(7)

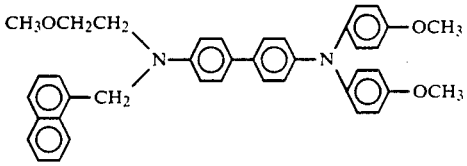

-continued (8)

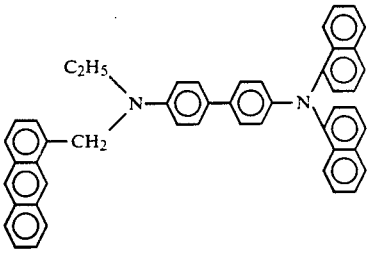

(9)

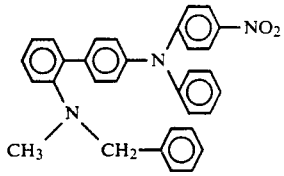

(10)

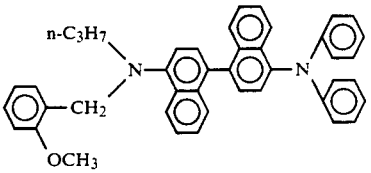

(11)

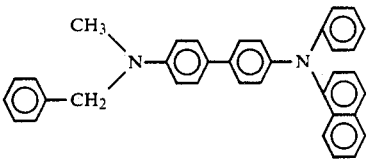

(12)

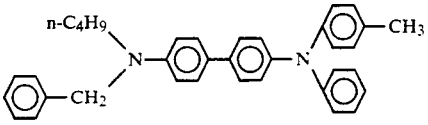

(13)

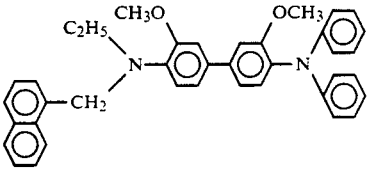

(14)

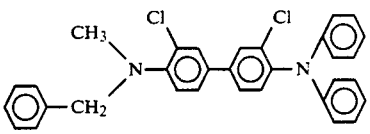

(15)

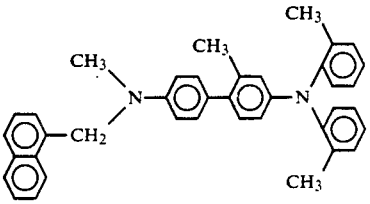

(16)

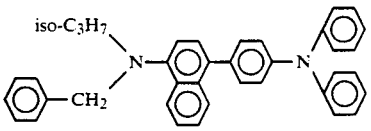

-continued (17)

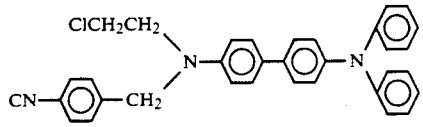

(18)

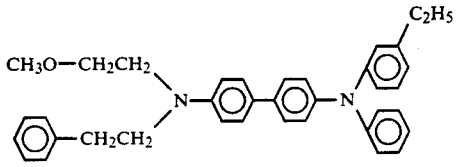

(19)

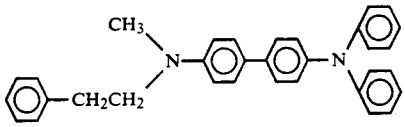

(20)

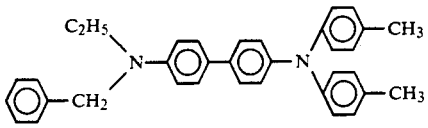

(21)

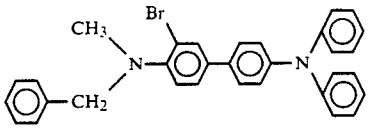

(22)

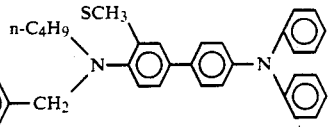

(23)

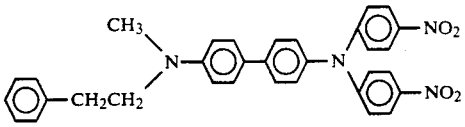

(24)

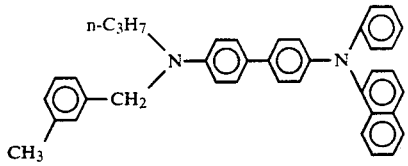

(25)

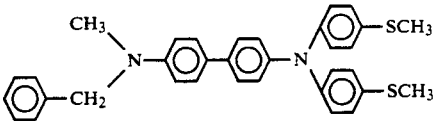

Of such compounds, with respect to extremely excellent resting memory prevention and prevention of sensitivity lowering and potential fluctuation, those wherein $R^1$ is selected from the group consisting of methyl, ethyl and propyl and $R^2$ is a group selected from benzyl, phenethyl and naphthyl methyl groups, particularly those wherein $R^1$ is methyl or ethyl group and $R^2$ is benzyl group are preferred.

Further, $R^3$ and $R^4$ may be preferably phenyl groups, and Ar and Ar' preferably divalent benzene ring groups.

Particularly, among these, those wherein $R^1$, $R^2$, $R^3$, $R^4$, Ar and Ar' are all unsubstituted groups are preferred.

In the following, a synthesis example of the above compound is shown. (Synthetic method of the exemplary compound No. (1))

An amount of 5.70 g (16.3 mmol) of 4-(N-methylamino)-4'-diphenylaminobiphenyl obtained by monomethylation of 4-amino-4'-diphenylaminobiphenyl by the known method was dissolved in 40 ml of anhydrous tetrahydrofuran, and 0.72 g (18.0 mmol) of oily sodium hydride (content 60%) was added slowly with stirring under ice-cooling. After completion of the addition, the mixture was returned to room temperature, and after stirred for 15 minutes. 3.08 g (18.0 mmol) of benzyl bromide was added dropwise slowly. After completion of the dropwise addition, the mixture was stirred at room temperature for 30 minutes, followed further by heating and stirring for 2 hours. After the reaction was over, the reaction mixture was poured into 200 ml of water, extracted with ethyl acetate, dried over anhydrous magnesium sulfate, and then the solvent was evaporated to dryness under reduced pressure. The crystals precipitated were purified by recrystallization to give 6.91 g of the exemplary compound (1). Elemental analysis for $C_{32}H_{28}N_2$ gave the results as shown below.

| | C (%) | (H %) | (N %) |
|---|---|---|---|
| Calcd. | 87.23 | 6.41 | 6.36 |
| Found | 87.20 | 6.45 | 6.35 |

FIG. 1 shows the IR-ray absorption spectrum (KBr tablet method).

Also, the compounds other than the synthesis example can be also synthesized generally according to similar procedures.

In the preferable specific example of the present invention, the compound represented by the above formula [I] can be used for the charge transporting substance contained in the charge transport layer of an electrophotographic photosensitive member having the functions of the photosensitive member separated into the charge generation layer and the charge transport layer.

The charge transport layer according to the present invention should be preferably formed by coating and drying a solution containing the compound represented by the above formula and a binder dissolved in an appropriate solvent. Also, it can be used together with other charge transporting substances. Examples of the binder to be used here may include polyarylate resin, polysulfone resin, polyamide resion, acrylic resin, acrylonitrile resin, methacrylic resin, vinyl chloride resin, vinyl acetate resin, phenol resin, epoxy resin, polyester resin, alkyd resin, polycarbonate, polyurethane or copolymer resins such as styrene-butadiene copolymer, styrene-acrylonitrile copolymer, styrene-maleic acid copolymer, etc. Also, other than such insulating polymers, organic photoconductive polymers such as polyvinylcarbazole, polyvinylanthracene or polyvinylpyrene, etc. can be used.

The ratio of the binder and the charge transporting substance of the present invention formulated may be preferably 10 to 500 parts by weight per 100 parts by weight of the binder.

The charge transport layer is electrically connected to the charge generation layer as described below and has the function of receiving the charge carriers injected from the charge generation layer in the presence of an electric field and also transporting these charge carriers to the surface. In this case, the charge transport layer may be laminated either on the charge generation layer or therebeneath. However, the charge transport layer should be desirably laminated on the charge generation layer. The charge transport layer is limited in ability to transport the charge carriers, and therefore the film thickness cannot be made thicker than is necessary. Generally, the film thickness may be 5 to 40 μm, but preferably in the range from 10 to 30 μm.

The organic solvent to be used in formation of such charge transport layer depends on the binder to be used, or should be preferably selected from those which do not dissolve the charge generation layer or the subbing layer as described below. Specific examples of the organic solvent may include alcohols such as methanol, ethanol, isopropanol and the like; ketones such as acetone, methyl ethyl ketone, cyclohexanone and the like; amides such as N,N-dimethylformamide, N,N-dimethylacetamide and the like; sulfoxides such as dimethyl sulfoxide and the like; ethers such as tetrahydrofuran, dioxane, ethylene glycol monomethyl ether and the like; esters such as methyl acetate, ethyl acetate and the like; aliphatic halogenated hydrocarbons such as chloroform, methylene chloride, dichloroethylene, carbon tetrachloride, trichloroethylene and the like; or aromatics such as benzene, toluene, xylene, monochlorobenzene, dichlorobenzene and the like.

Coating can be performed by use of the coating methods known in the art such as dip coating, spray coating, blade coating, etc. Drying may be preferably conducted according to the method in which heating drying is practiced after fine touch drying at room temperature. The heating drying may be conducted at a temperature of 30° C. to 200° C. within a time from 5 minutes to 2 hours, under stationary state or under air stream.

The charge transport layer can incorporate various additives added therein. For example, there may be included plasticizers such as diphenyl, m-terphenyl, dibutyl phthalate, etc.; surface lubricants such as silicone oil, the grafted type silicone polymer, various fluorocarbons, etc.; potential stabilizers such as dicyanovinyl compounds, carbazole derivatives, etc.; antioxidants such as β-carotin, Ni complex, 1,4-diazabicyclo[2,2,2]octane, etc.

The charge generation layer to be used in the present invention can be used as the vapor deposited layer or the coated layer by using singly or a combination of the materials selected from inorganic charge generating substances such as selenium, selenium-tellurium, amorphous silicon, etc.; organic charge generating substances such as cationic dyes, including pyrylium type dyes, thiapyrylium type dyes, azulenium type dyes, thiacyanine type dyes, quinocyanine type dyes, azulenium type dyes, etc., squvarilium salt type dyes, polycyclic quinone type dyes, including phthalocyanine pigments, anthanthrone type pigments, dibenzpyrenequinone type pigments, pyrhanthrone type pigments, etc., indigo type pigments, quinacridone type pigments, azo type pigments, etc.

Among the above charge generating substances to be used in the present invention, particularly azo type pigments include a diversity of kinds, and in the following, representative structural examples of the azo type pigments having particularly high effect are shown.

When the general formula of the azo type pigment is represented by the central backbone of A and the coupler portion of Cp as shown below:

$$A\text{-}(N{=}N{-}Cp)_n$$

(where n=2 or 3), first specific examples of A may include those set forth below.

A-1

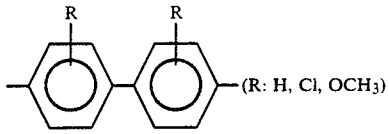

A-2

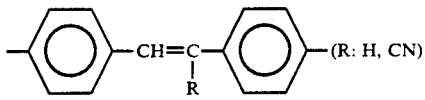

A-3

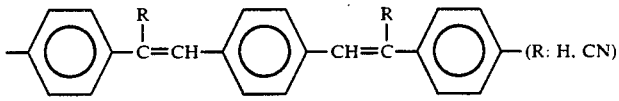

A-4

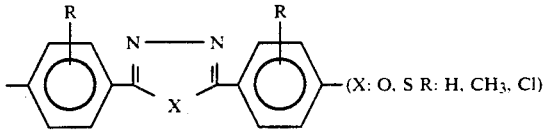

-continued
A-5
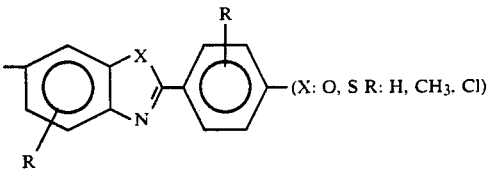
A-6
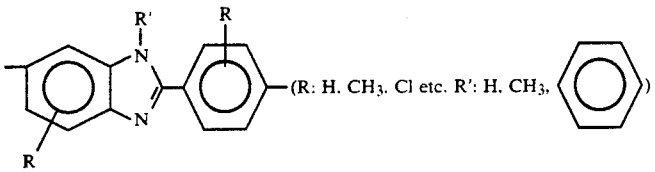
A-7
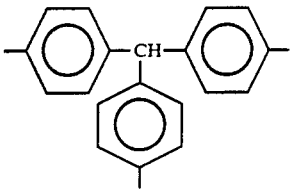
A-8
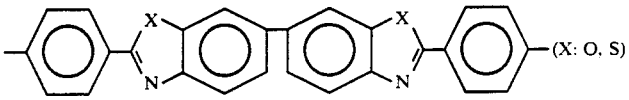
A-9
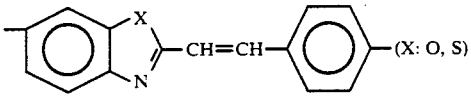
A-10
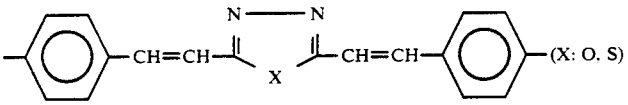
A-11
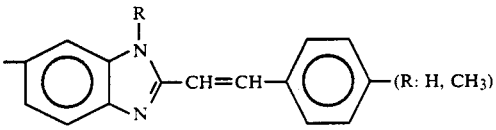
A-12
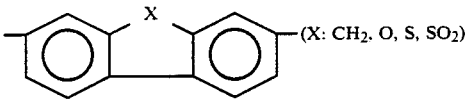
A-13
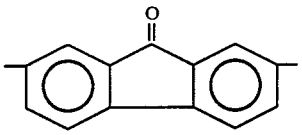
A-14
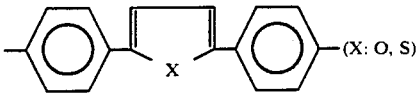
A-15
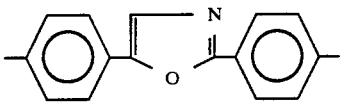

-continued
A-16
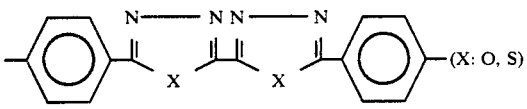
A-17
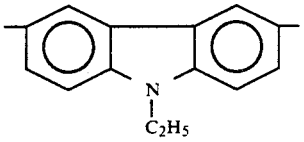
A-18
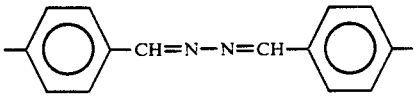
A-19
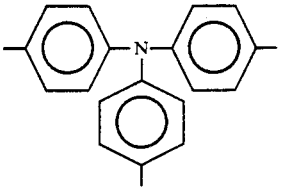
A-20
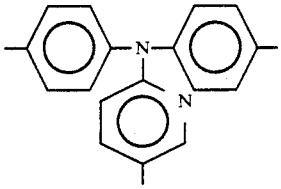
A-21
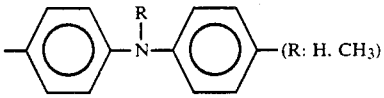
Specific examples of Cp:
Cp-1
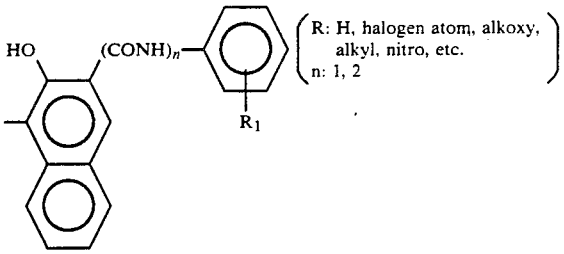
Cp-2
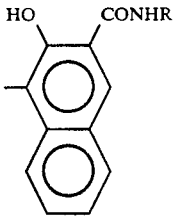
(R: $CH_3$, $C_2H_5$, $C_3H_7$)

-continued
Cp-3
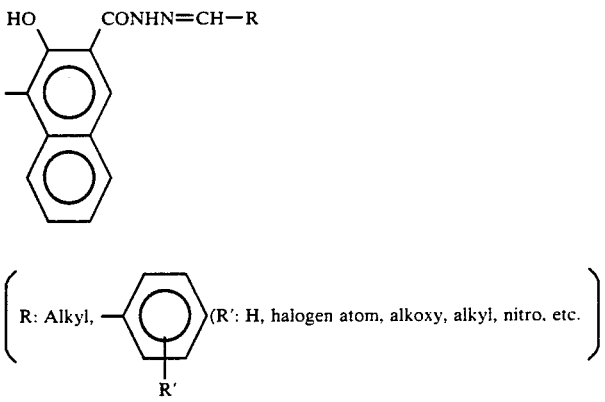
Cp-4
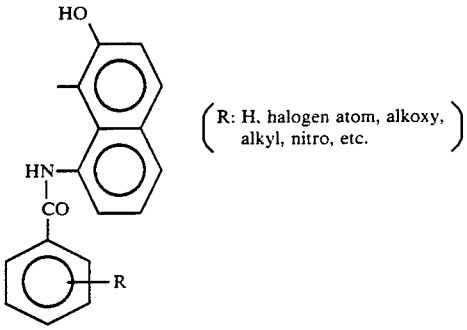
Cp-5
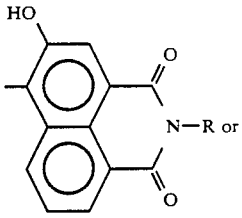
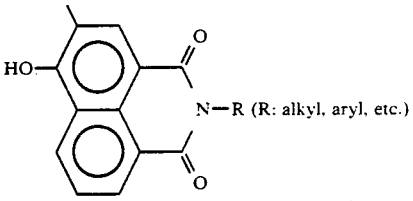
Cp-6
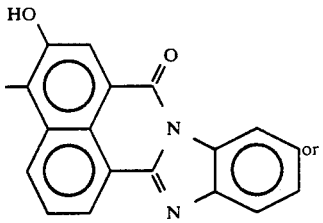
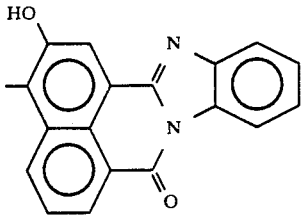

-continued

Cp-7

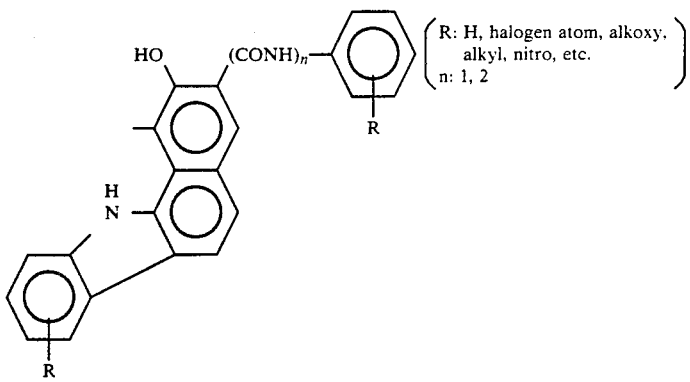

These center skelton A and coupler Cp form the pigment which becomes the charge generating substance according to a suitable combination. As the charge generating substance, phthalocyanine type pigments which are metal-free or have a metal in the center are also suitable for the present invention.

The charge generation layer can be formed by dispersing the charge generating substance as described above in a suitable binder and coating the dispersion on a support, and can be also obtained by forming a vapor deposited film by vacuum vapor deposition device. The above binder can be selected from a wide variety of insulating resins, and also from organic photoconductive polymers such as poly-N-vinylcarbazole, polyvinylpyrene, etc. Preferably, there may be employed insulating resins such as polyvinyl butyral, polyarylate (polycondensate of bisphenol A with phthalic acid), polycarbonate, polyester, polyvinyl acetate, acrylic resin, polyacrylamide resin, polyamide, cellulosic resin, urethane resin, epoxy resin, polyvinyl alcohol, etc. The resin contained in the charge generation layer may be suitably 80% by weight or less, preferably 40% by weight or less. As the organic solvent to be used during coating, alcohols, ketones, amides, sulfoxides, ethers, esters, aliphatic halogenated hydrocarbons, or aromatics, etc. can be used.

The charge generation layer, in order to obtain sufficient absorbance, should preferably contain as much organic photoconductive material as mentioned above, and also be made a thin film layer for injecting carriers into the charge transport layer within the life of the charge carriers generated, for example, a thin film layer having a film thickness of 5 μm or less, preferably 0.01 to 1 μm.

The photosensitive layer comprising such laminated structure of a charge generation layer and a charge transport layer is provided on an electroconductive support. As the electroconductive support, a support having itself electroconductivity, for example, a metal such as aluminum, aluminum alloy, stainless steel, etc. can be used, or otherwise a plastic having a coating such as of aluminum, aluminum alloy, indium oxide, tin oxide formed thereon by vacuum vapor deposition, a support coated with electroconductive particles together with a suitable binder on a plastic or the above metal support, a support impregnated with electroconductive particles into a plastic or paper or a plastic having an electroconductive polymer, etc. can be used.

It is also possible to provide a subbing layer having the barrier function and the adhesion function between the electroconductive support and the photosensitive layer. The subbing layer can be formed with casein, polyvinyl alcohol, nitrocellulose, ethylene-acrylic acid copolymer, polyamide, aluminum oxide, etc.

The subbing layer should have a film thickness suitably of 0.1 to 5 μm, preferably 0.5 to 3 μm.

The photosensitive layer may be also a single layer type photosensitive layer containing the charge generating substance and the charge transporting substance represented by the formula [I] in the same layer. In this case, the photosensitive layer should preferably have a film thickness of 10 to 50 μm, particularly 15 to 30 μm.

The electrophotographic photosensitive member of the present invention can be utilized not only for electrophotographic copying machine, but also widely for application fields of electrophotography such as laser printer, CRT printer, electrophotographic printing system, etc.

According to the present invention, an electrophotographic photosensitive member can be given, and also it has not only the advantage of small fluctuation in light portion potential and dark portion potential when repeated exposure and charging are performed, but also the advantage of being free from the resting memory phenomenon as described above.

The present invention is described in detail below by referring to Examples, but the present invention is not limited thereby at all.

EXAMPLE 1

By use of an aluminum cylinder with a diameter of 80 mm and a length of 360 mm as the electroconductive support, this was coated with a 5% methanolic solution of a polyamide resin (trade name: Amilan CM-8000, manufactured by Toray) by the dipping method to provide a subbing layer with a thickness of 0.5 μm thereon. Next, 10 parts (parts by weight, hereinafter the same) of a disazo pigment of the following structural formula as the charge generating substance,

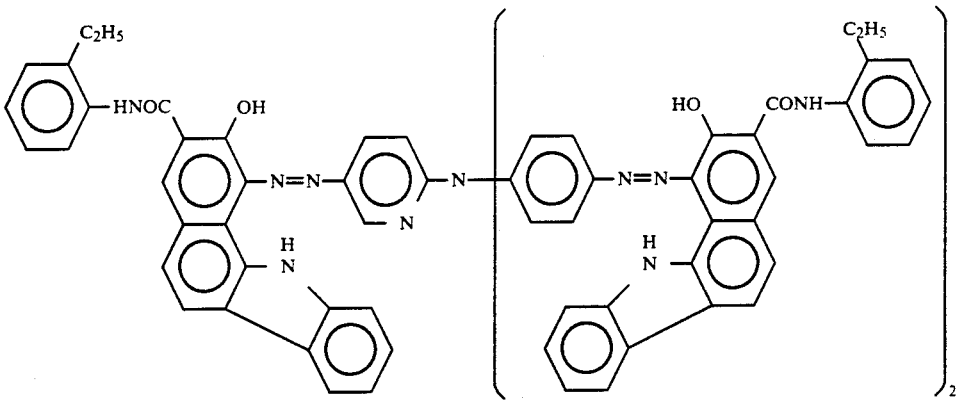

6 parts of a polyvinyl butyral resin (trade name: S rec. BL-S, manufactured by Sekisui Kagaku) and 50 parts of cyclohexanone were dispersed by a sand mill device with the use of glass beads. To the resultant dispersion were added 100 parts of methyl ethyl ketone, and the mixture was applied on the subbing layer to form a charge generation layer with a thickness of 0.2 μm.

Next, a solution of 10 parts of the above exemplary compound (1) as the charge transport substance, 10 parts of a polycarbonate resin (trade name: Panlite-1250, manufactured by Teijin) dissolved in 50 parts of dichloromethane and 10 parts of monochlorobenzene was applied on the above charge generation layer to form a charge transport layer with a thickness of 19 μm, thus preparing a photosensitive drum.

EXAMPLES 2-6

Photosensitive drums were prepared in the same manner as in Example 1 except for using the exemplary compounds (5), (13), (19), (20), (25) in place of the exemplary compound (1) used in Example 1 as the charge transporting substance.

COMPARATIVE EXAMPLES 1-4

Photosensitive drums were prepared in the same manner as in Example 1 except for using the charge transporting substances of the following structural formulae (26)-(29):

(26)

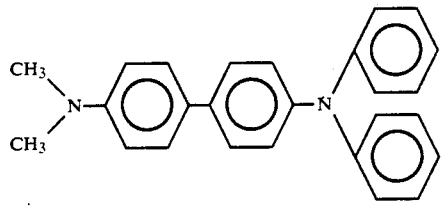

(27)

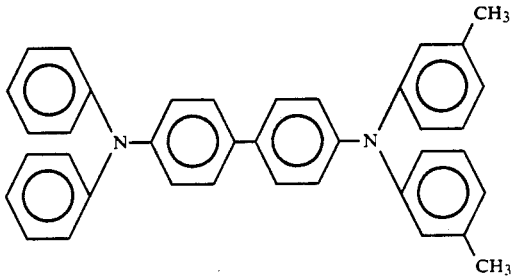

-continued (28)

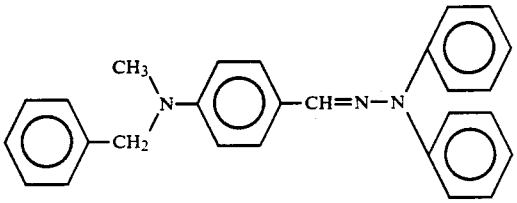

(29)

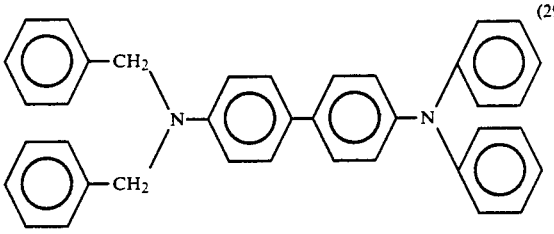

The above photosensitive members were each mounted on a copying machine NP-3525 manufactured by Canon modified to a blade penetration amount of 1.0 mm, a relative speed of cleaning roller of 106%, and their characteristics were evaluated as described below. First, the respective latent conditions were set so that the dark portion potential ($V_D$) and the light portion potential ($V_L$) became −650 V and −150 V, respectively. The image exposure dose at that time was determined to be the initial sensitivity.

Next, the potential after continuous copying of 5,000 sheets was measured, and the change ratio in $V_D$ and $V_L$ were determined. For example, the change ratio of 2% in $V_D$ means 2% of 650 V, namely the change of 13 V. Then, the photosensitive member was left to stand in the copying machine, and the surface potential after 10 hours was measured.

The portion of the photosensitive member positioned immediately below the corona charger during the standing was marked, and the difference from the other portion ($\Delta V_D$) was determined. Further, continuous copying of 5,000 sheets was performed (10,000 sheets of copying as the total), and the same setting as above was done. The portion of the photosensitive member positioned immediately below the corona charger is made the same as in the case of initial copying of 50,000 sheets. The results are shown in Table 1.

TABLE 1

| | Charge transporting substance compound No. | Initial sensitivity (lux sec) | $V_D$ change ratio (%) 5,000 sheets/ 10,000 sheets | | $V_L$ change ratio (%) 5,000 sheets/ 10,000 sheets | | $\Delta V_D$(V) after standing 5,000 sheets/ 10,000 sheets | |
|---|---|---|---|---|---|---|---|---|
| Example 1 | (1) | 1.2 | 0.9 | 1.4 | 1.3 | 2.7 | 4 | 9 |
| Example 2 | (5) | 1.4 | 1.4 | 2.0 | 3.3 | 5.3 | 9 | 13 |
| Example 3 | (13) | 1.7 | 2.1 | 2.8 | 4.7 | 6.0 | 11 | 15 |
| Example 4 | (19) | 2.3 | 3.4 | 4.0 | 6.5 | 7.0 | 16 | 20 |
| Example 5 | (20) | 1.3 | 1.0 | 1.5 | 1.3 | 2.9 | 5 | 9 |
| Example 6 | (25) | 1.8 | 1.4 | 1.9 | 6.0 | 7.3 | 10 | 16 |
| Comp. Example 1 | (26) | 3.8 | 10.3 | 12.4 | 12.1 | 15.1 | 62 | 81 |
| Comp. Example 2 | (27) | 5.5 | 15.4 | 20.1 | 24.1 | 36.5 | 104 | 127 |
| Comp. Example 3 | (28) | 3.1 | 16.2 | 23.9 | 20.0 | 39.1 | 74 | 91 |
| Comp. Example 4 | (29) | 3.6 | 13.2 | 15.4 | 17.3 | 18.1 | 79 | 90 |

As is apparent from Table 1, it can be seen that when the compound of the present invention is used in the charge transport layer, not only sensitivity, durable potential change (change ratio in $V_D$, $V_L$ in Table 1) are excellent, but also the potential fluctuation ($\Delta V_D$) immediately below the charger which has become the problem in recent years is extremely small.

EXAMPLE 7

After 3 parts of 4-(4-dimethylaminophenyl)-2,6-diphenylthia-pyrylium perchlorate and 3 parts of poly(4,4'-isopropylidene-diphenylene carbonate were thoroughly dissolved in 200 ml of dichloromethane, 1,000 ml of toluene was added to precipitate the eutectic complex. The precipitate was separated by filtration, then redissolved with addition of dichloromethane, and then 100 ml of n-hexane was added to the solution to obtain precipitates of the eutectic complex. The eutectic complex (5 g) was added into 95 ml of a methanolic solution containing 2 g of polyvinyl butyral, and the mixture was dispersed in a ball mill for 6 hours. The dispesion was applied by a Myer bar on an aluminum plate having a casein layer to a film thickness after drying of 0.4 μm to form a charge generation layer.

Next, 10 parts of the above exemplary compound (11) as the charge transporting substance and 10 parts of poly(4,4-isopropyli-denediphenylene carbonate) were dissolved in 50 parts of dichloromethane and 10 parts of monochlorobenzene to prepare a charge transport layer coating solution. This was applied by a Myer bar on the above charge generation layer to a film thickness after drying of 19 μm, to prepare a photosensitive member. The photosensitive member thus prepared was plastered on the cylinder for photosensitive drum as used in Example 1, and its electrophotographic characteristics were evaluated according to the same method as in Example 1.

COMPARATIVE EXAMPLE 5

Also, for comparative purpose, a photosensitive member was prepared by use of the compound of the structural formula (30) shown below in place of the above exemplary compound (11) and evaluated similarly.

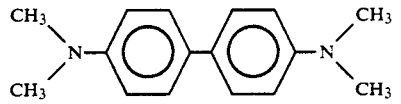

(30)

The results are shown in Table 2.

TABLE 2

| | Charge transporting substance compound No. | Initial sensitivity (lux sec) | $V_D$ change ratio (%) 5,000 sheets/ 10,000 sheets | | $V_L$ change ratio (%) 5,000 sheets/ 10,000 sheets | | $\Delta V_D$(V) after standing 5,000 sheets/ 10,000 sheets | |
|---|---|---|---|---|---|---|---|---|
| Example 7 | (11) | 3.0 | 2.4 | 3.9 | 3.5 | 5.7 | 9 | 14 |
| Comp. Example 4 | (30) | 6.9 | 16.9 | 24.4 | 24.5 | 29.7 | 51 | 69 |

EXAMPLE 8

On an aluminum plate was applied a 5% methanolic solution of a soluble nylon (6-66-610-12 quaternary nylon copolymer) to form a subbing layer with a dried film thickness of 0.7 μm.

Next, as the charge generating substance, 5 g of a disazo pigment represented by the following formula:

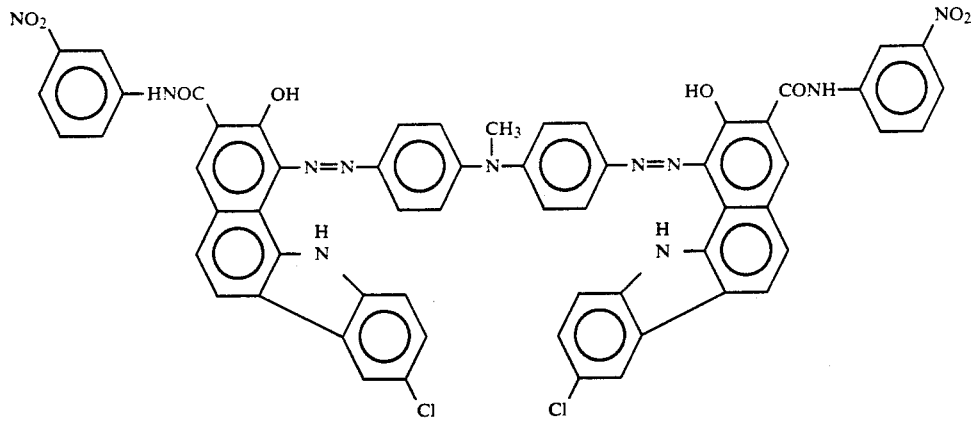

was dispersed in 95 ml of tetrahydrofuran in a sand mill for 20 hours. Subsequently, a solution of 5 g of the above exemplary compound (14) and 10 g of a bisphenol Z type polycarbonate resin (visocisy average molecular weight 30,000) dissolved in 30 ml of monochlorobenzene was added to the dispersion previously formed, and the mixture was further dispersed for 2 hours. The dispersion was applied by a Myer bar on the subbing layer previously formed to a film thickness after drying of 20 μm, and dried to form a single layer type photosensitive layer. The photosensitive member thus prepared was plastered on the cylinder for photosensitive drum as used in Example 1, and its electrophotographic characteristics were evaluated.

COMPARATIVE EXAMPLE 5

A photosensitive member was prepared as described in Example 8 except for using a compound of the following structural formula (31) in place of the exemplary compound (14) used in Example 8, and evaluated similarly.

(31)

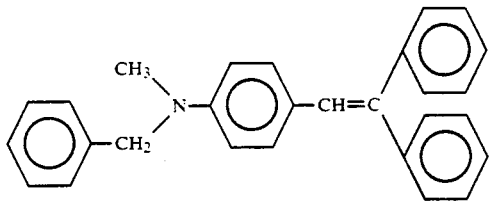

The results are shown in Table 3.

TABLE 3

| | Charge transporting substance compound No. | Initial sensitivity (lux sec) | $V_D$ change ratio (%) 5,000 sheets/ | 10,000 sheets | $V_L$ change ratio (%) 5,000 sheets/ | 10,000 sheets | $\Delta V_D$(V) after standing 5,000 sheets/ | 10,000 sheets |
|---|---|---|---|---|---|---|---|---|
| Example 8 | (14) | 2.5 | 3.1 | 4.5 | 4.7 | 6.7 | 11 | 20 |
| Comp. Example 5 | (31) | 7.9 | 27.8 | 47.1 | 29.9 | 37.4 | 101 | 169 |

We claim:

1. An electrophotographic photosensitive member having a photosensitive layer laminated on an electroconductive support, wherein the photosensitive layer contains a compound represented by the following formula:

Formula: [I]

-continued

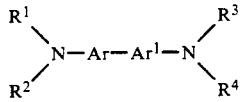

wherein $R^1$ represents an alkyl group; $R^2$ represents an aralkyl group; $R^3$ and $R^4$ each represent an aromatic ring group and Ar and Ar' each represent a divalent aromatic ring group said photosensitive layer (i) is a laminated structure of a charge generating layer and charge transporting layer wherein the compound represented by formula is contained in the charge transporting layer or (ii) is a single layer containing a charge generating substance and a charge transporting substance wherein the compound represented by formula is the charge transporting substance, whereby said electrophotographic photosensitive member is of the kind which can act to prevent corona products from deteriorating the electrophotographic properties of said member.

2. An electrophotographic photosensitive member according to claim 1, wherein $R^1$ in the formula [I] is a group selected from the group consisting of methyl, ethyl and propyl groups, and $R^2$ is a group selected from the group consisting of benzyl, phenethyl and naphthyl methyl groups.

3. An electrophotographic photosensitive member according to claim 2, wherein $R^1$ in the formula [I] is methyl or ethyl group, and $R^2$ is benzyl group.

4. An electrophotographic photosensitive member according to claim 2, wherein $R^3$ and $R^4$ are phenyl groups, and Ar and Ar' are divalent benzene ring groups.

5. An electrophotographic photosensitive member according to claim 3, wherein $R^3$ and $R^4$ are phenyl groups, and Ar and Ar' are divalent benzene ring groups.

6. An electrophotographic photosensitive member according to claim 4, wherein $R^1$, $R^2$, $R^3$, $R^4$, Ar and Ar' are all unsubstituted groups.

7. An electrophotographic photosensitive member according to claim 5, wherein $R^1$, $R^2$, $R^3$, $R^4$, Ar and Ar' are all unsubstituted groups.

8. An electrophotographic photosensitive member according to claim 1, wherein the photosensitive layer has a laminated structure of a charge generation layer and a charge transport layer, and the compound represented by the formula [I] is contained in the charge transport layer.

9. An electrophotographic photosensitive member according to Claim 8, wherein the charge transport layer is composed primarily of said compound and a binder.

10. An electrophotographic photosensitive member according to claim 8, wherein the charge generation layer contains an azo type pigment or a phthalocyanine type pigment as the charge generating substance.

* * * * *

UNITED STATES PATENT AND TRADEMARK OFFICE

CERTIFICATE OF CORRECTION

PATENT NO. : 5,126,223

DATED : June 30, 1992

INVENTOR(S) : TOSHIHIRO KIKUCHI, ET AL.

It is certified that error appears in the above-identified patent and that said Letters Patent is hereby corrected as shown below:

IN [57] ABSTRACT

In Formula (I), "$Ar^1$" should read --Ar′--.

COLUMN 1

Line 34, "containing" should read --contained--.
Line 35, "with" should read --from--.

Line 60, "a" should be deleted.

COLUMN 2

Line 14, "$Ar^1$" should read --Ar′--.
Line 45, "Nox" should read --NOx--.
Line 60, "tive" should read --tive member--.

COLUMN 6

Lines 8-9, "(Synthetic method of the exemplary compound No. (1))" should be set as a subhead.

COLUMN 8

Line 21, "squvarilium" should read --squarilium--.
Line 24, "pyrhanthrone" should read --pyranthrone--.

COLUMN 15

Line 18, "skelton" should read --skeleton--.

UNITED STATES PATENT AND TRADEMARK OFFICE

CERTIFICATE OF CORRECTION

PATENT NO. : 5,126,223

DATED : June 30, 1992

INVENTOR(S) : TOSHIHIRO KIKUCHI, ET AL.

It is certified that error appears in the above-identified patent and that said Letters Patent is hereby corrected as shown below:

COLUMN 19

Line 35, "carbonate" should read --carbonate)--.
Line 45, "dispesion" should read --dispersion-- and "Myer" should read --Meyer--.
Line 68, "Myer" should read --Meyer--.

COLUMN 20

TABLE 2, "Example 4" should read --Example 5--.

COLUMN 21

Line 22, "(visocisy" should read --(viscosity--.
Line 26, "Myer" should read --Meyer--.
Line 33, "EXAMPLE 5" should read --EXAMPLE 6--.
TABLE 3, "Example 5" should read --Example 6--.

COLUMN 22

Line 22, "$Ar^1$" should read --Ar′--.
Line 28, "group" should read --group;--.
Line 31, "formula" should read --formula [I]--.
Line 34, "formula" should read --formula [I]--.

UNITED STATES PATENT AND TRADEMARK OFFICE

CERTIFICATE OF CORRECTION

PATENT NO. : 5,126,223

DATED : June 30, 1992

INVENTOR(S) : TOSHIHIRO KIKUCHI, ET AL.

It is certified that error appears in the above-identified patent and that said Letters Patent is hereby corrected as shown below:

COLUMN 24

Line 4, "Claim 8," should read --claim 8,--.

Signed and Sealed this

Twenty-fifth Day of January, 1994

*Attest:*

Bruce Lehman

BRUCE LEHMAN

*Attesting Officer*

*Commissioner of Patents and Trademarks*